United States Patent [19]

McFadden

[11] 4,367,840

[45] Jan. 11, 1983

[54] CONTAINER

[75] Inventor: Richard D. McFadden, London, Canada

[73] Assignee: Labatt Brewing Company Limited, London, Canada

[21] Appl. No.: 318,700

[22] Filed: Nov. 6, 1981

Related U.S. Application Data

[63] Continuation-in-part of Ser. No. 134,079, Mar. 26, 1980, abandoned.

[51] Int. Cl.[3] ..... B65D 5/10; B65D 5/66

[52] U.S. Cl. ..... 229/39 R; 229/38; 229/41 B

[58] Field of Search ..... 229/38, 39 R, 41 B

[56] References Cited

U.S. PATENT DOCUMENTS

| | | | |
|---|---|---|---|
| 2,337,198 | 12/1943 | Holy | 229/39 R |
| 2,361,603 | 10/1944 | Cohen | 229/39 R |
| 2,710,135 | 6/1955 | Gaylord | 229/52 B |
| 3,294,221 | 12/1966 | Natko | 229/39 R |
| 3,302,853 | 2/1967 | Locke | 229/39 R |
| 3,539,090 | 11/1970 | Blardell | 229/38 |

FOREIGN PATENT DOCUMENTS

| | | | |
|---|---|---|---|
| 1016913 | 6/1977 | Canada | 229/39 R |
| 103931 | 3/1966 | Denmark | 229/41 B |

*Primary Examiner*—Herbert F. Ross
*Attorney, Agent, or Firm*—Bernard Beasley

[57] ABSTRACT

The present invention concerns a container such as that used to enclose beer bottles which container is made of cardboard in the usual manner. The carton may be sealed manually by the provision of carton side panels with tabs which are adapted to enter associated slots in underlying end panels and thereby secure said side panels to said end panels thus sealing the carton. The carton may also be sealed using an adhesive and presently used high-speed equipment and consequently the user need only maintain an inventory of one type of carton to cover both applications.

9 Claims, 4 Drawing Figures

CONTAINER

This is a continuation-in-part application of application Ser. No. 134,079 filed Mar. 26, 1980 and now abandoned.

The present invention relates to containers or cartons for packaging of bottled and canned beverages or the like for distribution.

BACKGROUND OF THE INVENTION

The provision of packaging means e.g. containers or cartons for the distribution of bottled and canned beverages, for example beer and ale, is a major aspect of the beverage manufacturing industry in North America and elsewhere. The container itself should be of the lowest cost consistent with adequate protection, both mechanical and, important from an alcoholic beverage viewpoint, from light, for its contents. It should be supplied to the beverage manufacturer in a compact (usually flat or "knocked down") form and must be conveniently, i.e. easily and rapidly erectable for reception of bottles or cans containing the beverage and sealed following such filling.

Many containers (cartons) at present in use in the alcoholic beverage industry are of the top loading type, that is, the top wall of the carton is constituted by a pair of side panels and a pair of end panels, attached to associated side and end walls; overlying the end panels and extending from its associated side wall to about the midpoint of the carton so as to abutt, but not overlap, the other side panel. The cartons are supplied by the manufacturer in a collapsed condition and are in most instances erected mechanically leaving the panels in an opened condition to allow the bottles or cans to be introduced by dropping into the container. The end panels are then folded into position overlying the bottles or cans; adhesive applied to the outer surface thereof; and the side panels are then folded over and onto the side flaps and become secured thereto by the adhesive. Further, many of such containers have a handhole in one end wall; refer, for example, to U.S. Pat. No. 2,710,135. It should be emphasized, that such containers generally enclose six, twelve or even twenty-four bottles or cans which, when filled, constitute a relatively heavy load and apply quite severe mechanical strains to the container. For example, six filled "pint" bottles of an alcoholic beverage such as ale or beer weigh about 120 oz. In many instances, for example, in the Canadian context where all such bottles and cans are returnable, the container must also be adapted to receive the bottles or cans when empty to enable same to be returned. The result is that, when the cartons are being carried there is a force created tending to disengage the side panels from the end panels and so open the container with obviously disadvantageous results. Although as stated, in most instances such containers are sealed with adhesive using high speed equipment, there are a significant number of occasions, such as when a carton is damaged in a retail store or the beverage in question has such a low volume that running a high speed packaging line is not justified, when hand packaging or repackaging, is carried out. Presently, in the latter situations, all the operations including the gluing and sealing the containers are messy, inconvenient time-consuming manual operations.

In various food areas, for example, the packaging of breakfast cereals, etc., containers or cartons are known of the type wherein the top wall is constituted by two overlapping side flap members, which, in the original unopened condition are glued together. Upon opening, a tab is formed in the middle portion of one flap, which tab is adapted to be inserted into a slot in the other side flap whereby the two side flaps are maintained in a loose engagement and so close the container; the objective being to prevent ingress of foreign matter such as dust or the like into the container. The arrangement contributes little, if any, mechanical strength to the package which characteristic, in any event, is not important or required in such applications. In such containers, the tab is loosely located in its associated slot and is in a plane virtually parallel to the top wall of the container, i.e. such containers are merely closed rather than tightly sealed as is the case of the beer and similar containers.

A similar objective is achieved in the carton disclosed in Canadian Pat. No. 812,099 by providing each end flap with a tab having a neck portion secured or hinged to said end flap and a transverse locking tongue member. Corresponding side flaps have notches in their abutting end edges such that when the side flaps are in an abutting relationship overlying the interior of the container, adjacent notches combine to define an aperture. To close the container, the locking tongue is inserted through the aperture and abutts the top surface of the underlying end flap thereby loosely "locking" the container. As taught by the patent, such containers are used to enclose large but light items. A very similar container is disclosed in Canadian Pat. No. 1,016,913, the only difference being that the tongue member is bendible so as to be able to contact the underside of the end flap. Both these containers are designed for light loads and, as indicated by the lack of handholes or the like, when carried, are obviously intended to be supported from a mechanical viewpoint by the arms of the person carrying them. Additionally, the containers are designed to be used without the need for costly packaging equipment. If such a container, carrying any significant load whatsoever, were to be supported by a handle or the like on an end wall, the locking tongue or whole tab would, unless the carton material used was impracticably strong, be torn away. Moreover, such a handle would also be ineffective if included on a side wall since the bowing effect caused by the container contents would merely result in the side flap becoming disengaged from its associated locking tab arrangement and the carton opening with potentially disastrous results for the contents.

In summary, these containers are closed for presentation purposes, the means of closing the containers not assisting the mechanical strength and integrity of the container in any manner.

An object of the present invention is to provide a beer carton or like container for containing relatively heavy loads and which may conveniently and rapidly be sealed manually without adhesive but which carton may, if required, be sealed with adhesive using standard high speed automated equipment.

STATEMENT OF THE INVENTION

It has been found that a carton of the type described but which has a tab in each side panel and associated slots and slits in underlying end panels, which slots are inclined at an angle to the hinge between the end panel and the associated side wall and which slits extend away from the extremity of the slots remote from the respective end wall at an angle sufficient to ensure engagement between the tab and at least a portion of an edge of the slit, can be closed following filling with product using adhesive and the presently used high speed automated equipment or can be sealed manually via the tab and slot arrangement, both methods of sealing resulting in a structurally sound and presentable container.

According to the present invention there is provided a container of the type described which includes a base, end and side walls connected by hinge lines to one another; opposing pairs of end and side panels connected by hinge lines to the upper edges of respective end and side walls and extending substantially the length thereof, each end and side panel being adapted to fold toward its opposing respective end or side panel, said side panels being further adapted to overlie said end panels and co-act therewith to form the top wall with the longitudinal edges of said side walls substantially abutting; one of said end panels being provided with a pair of slots, each said slot being oriented at an angle to the hinge line between said end panel and respective end wall; said end panel being further provided with a slit extending away from the extremity of each said slot remote from the respective end wall; a pair of tabs, each tab disposed in the area of its respective side panel adapted to overlie said end panel containing said slots, said tabs being adapted to bend out of the plane of its respective side panel and enter said slots such that the tabs extend partially under a portion of the end panel adjacent the join of said slots and slits thereby engaging at least a portion of an edge of said slits, whereby said side and end panels are adapted to be mechanically secured together.

In its basic form, therefore, the two side panels are secured to one and the same end panel to form the top wall. In those cases wherein a handhole in provided in the carton the said securing arrangement involves the end panel attached to the end wall carrying the handhole.

In most instances, however, each side panel will be secured to each underlying end panel and in the region of the latter adjacent the associated end wall.

In a further aspect, therefore, the present invention provides a container of the type described which includes a base, end and side walls connected by hinge lines to one another; opposing pairs of end and side panels connected by hinge lines to the upper edges of respective end and side walls and extending substantially the length thereof, each end and side panel being adapted to fold toward its opposing respective end or side panel, said side panels being further adapted to overlie said end panels and co-act therewith to form the top wall with the longitudinal edges of said side walls substantially abutting; said end panels being provided with a pair of slots, each said slot being oriented at an angle to the hinge line between said end panel and respective end wall; said end panels being further provided with a slit extending away from the extremity of each said slot remote from the respective end wall; a pair of tabs on each side panel, each tab disposed in the area of its respective side panel adapted to overlie said end panels, said tabs being adapted to bend out of the plane of their respective side panel and enter said slots such that the tabs extend partially under a portion of the end panel adjacent the join of said slots and slits thereby engaging at least a portion of an edge of said slits, whereby said side and end panels are adapted to be mechanically secured together. It is preferable that each slot is oriented at an angle of from about 45° to about 135° to the hinge line between the end panel containing the slot and the end wall associated with that panel. Moreover, it is also preferred that the line defining the base line of the tab, which line is preferably a hinge line to assist deflecting the tab out of the plane of the end wall, is also at an angle of about 45° to about 135° to a line which includes the hinge line between the side panel carrying the tab and its associated side wall. It is most preferable that the slot and the said line defining the tab base substantially coincide when the side panels overlie the associated end panels as described above.

Also, deflecting the tabs out of the plane of the side panels is most conveniently effected when the tabs are located in the free "corner" regions of the end panels, i.e. the adjoining portions of the three longitudinal and lateral edges of the panels define in part the tab members. The third free or inner side of the tab may generally be of any configuration but preferably is arcuate resulting in the width of the tab at its free end being less than that of its base, a shape which assists in introducing the tab through its associated slot. Other shaped tabs may be used provided the free end is of less width than the base, the latter generally having a width not substantially less than the length of the associated slot.

On entry of the tabs into the slots, substantially all of each tab passes through its associated slot and is restrained from slipping out thereof since the board material defining the edges of the slot urges against the tab. It is highly preferred, therefore, that substantially no board material is removed or cut out in forming the slots. The tabs are further adapted, on entering the slots, to extend partially under a portion of the end panel adjacent the join of the slots and associated slits such that the inner side of each tab engages at least a portion of an edge of the associated slit whereby the mechanical locking or securing of the side and end panels is ensured.

In combination with their associated slots, the slits also provide a temporary "door" or relatively wide opening as the associated tabs are inserted and thereby greatly facilitate the entry of the tabs into the slots by deflection of the material between the slots and slits. Once the tabs have been inserted, the deflected material then constantly urges against the underside of the associated tab to restrain same. It is preferred that the slits are of a small length relative to that of the associated slots. It is further preferred that each slit extends away from its associated slot in a direction parallel to the upper edge of the respective end wall and in a direction toward the associated tab such that the angle defined by the slot and the slit is an acute angle.

The present invention will be further described, but not limited by, reference to the accompanying drawings in which.

Figure 1:
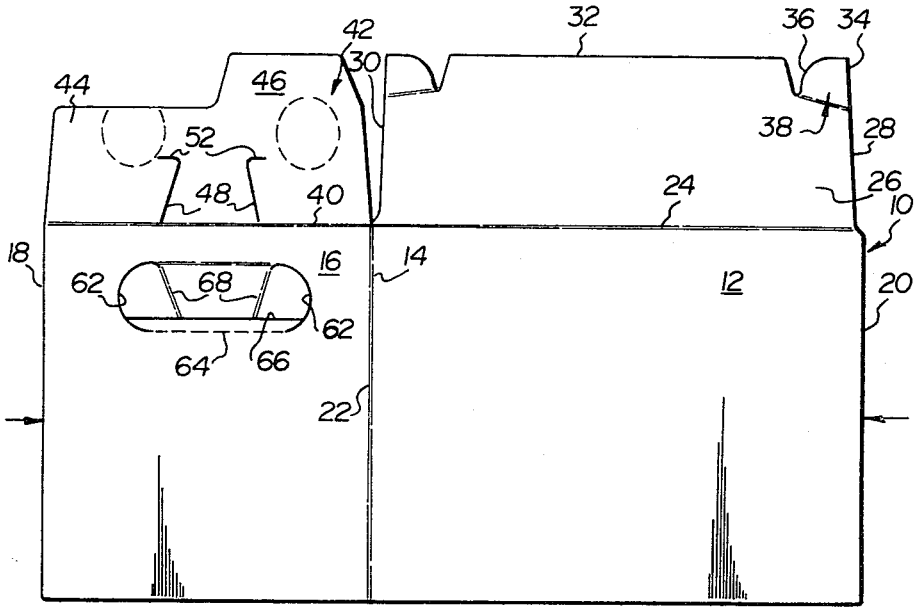
FIG. 1 is a container of the present invention taking the form of a "six-pack" beer carton.
Figure 3:
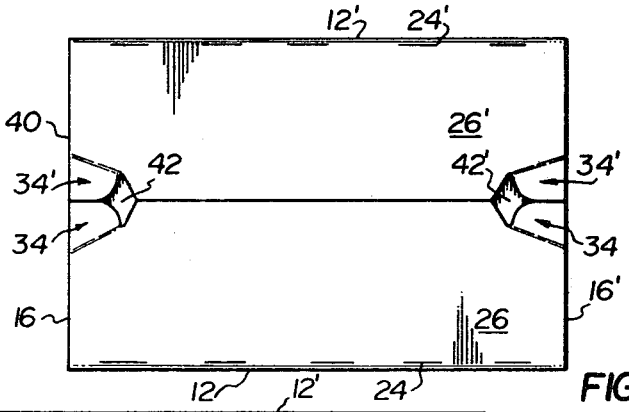
Figure 4:
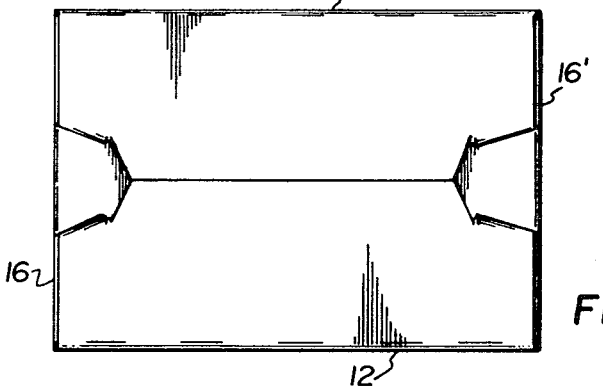

FIG. 3 is plan view of the carton of FIG. 1 but wherein the side panels have also been folded towards each other and overlie and are secured to the end panels with adhesive means using the standard high speed equipment; and FIG. 4 is a similar view to that shown in FIG. 3 but wherein the side panels have been folded towards each other, the side panel tab members have been inserted through their associated slots in the underlying end panels so as to secure the side panels to the end panels to form the carton top wall in a mechanical manner without the use of adhesive in the manner taught by the present invention.

The beer carton shown in FIGS. 1 to 4, for the reasons given below, constitutes a preferred embodiment of the present invention and is described in detail as follows. The carton generally designated 10 is a "six-pack", adapted or designed to contain six twelve-fluid imperial ounce bottles (commonly called "pint") of an alcoholic brewery product such as beer. The carton 10 is in the collapsed condition as it is received by the brewer from the manufacturer and comprises first side wall 12 affixed via crease hinge line 14 to an end wall 16. End wall 16 is similarly affixed to a second side wall 20' (not shown in FIG. 2) by hinge line 18 and side wall 20' is affixed to a second end wall 16' (also not shown in FIG. 2) which in turn is affixed to first side wall 12 via hinge line 20. Bottom side and end panels (not shown) which, upon the carton being erected, form the base wall 13, are enclosed within the sleeve formed by the side and end walls. The construction of such panels and their arrangement to form the base wall are well known in the art and utilized in many standard cartons such as the beer six-pack produced in Canada by The Continental Can Company under No. 530. The carton is manufactured in the usual manner from one piece cardboard blank and the usual glue joint to form the basic sleeve structure is denoted by 22. Affixed to side wall 12 via slotted hinge line 24 is side panel 26 defined generally by edges 28, 30 and 32. A tab 34 defined generally by edges 28 and 32 in part and curved edge 36 is formed at each end of panel 26 by simply punching, as the blank is formed, a roughly triangular portion of the material from panel 26. The base of each tab 34 is formed by a hinge line 38 which, it will be noted, is inclined at an angle to the endwalls of the carton when erected and also to longitudinal hinge-lines 24. Panel 26' is similar to panel 26 having similar tab members 26' and is affixed to side wall 20' by hinge line 24'.

Affixed to end wall 16 via hinge line 40 is end panel 42 which consists of a main body portion 44 and extending therefrom a tongue member 46: it may be noted that the combined width w of body member 44 and tongue member 46 is only about one-third the length of the full container and consequently, when the end panels are folded down so as to overlie the interior, and the contents, of the carbon there is a space or gap between the outer edges thereof of about one-third the length of the carton. As the man skilled in the art will readily appreciate, the spacing and the tongue arrangement are provided and indeed required, so as to enable the carton to be filled and sealed by high speed automatic equipment. In particular, the standard plough members, each of which folds over one end panel by contacting the tongue member of that end panel would prevent the folding inwards of the second end panel if the second end panel has a width equivalent to the width of the body member 44 and tongue 46. In other words, the provision of tongue 46 may be considered to be equivalent to the provision of a cutout in the panel adjacent tongue 46 through which cutout the plough which folds over the opposing end panel may pass without contacting the one end panel. A major feature of the present invention comprises providing in each end panel 42 (and 42') a slot 50 (and 50') oriented at an angle to hinge line 40, (and consequently end wall 15, when panel 42 is folded to overlie the carton interior) and a slit 52 which, in the embodiment shown, is located parallel to hinge line 40, (and end wall 16), and extends from the end of slot 50 (and 50') from end wall 16, so as to define a triangular "door". In this embodiment, no panel material is removed, and each end panel 44 and 44' are provided with a pair of slots 50 and 50' respectively. It may be noted that these slots are located in the portion of the panel adjacent the hinge line 40 and indeed extend substantially to hinge line 40.

End wall 16 is provided with a potential handhole 60 defined by side slits 62; perforated hinge line 64; and potential slit 66. Two crease hinge lines 68 extend, at an angle, from the upper extremities of slits 62 to horizontal slit 66. In smaller cartons, such as the beer six-packs shown in the accompanying drawings, only one end wall is provided with such a handhole. However, larger containers, for example, a beer 24-case, will generally have such a handhole in both end walls.

Figure 2:
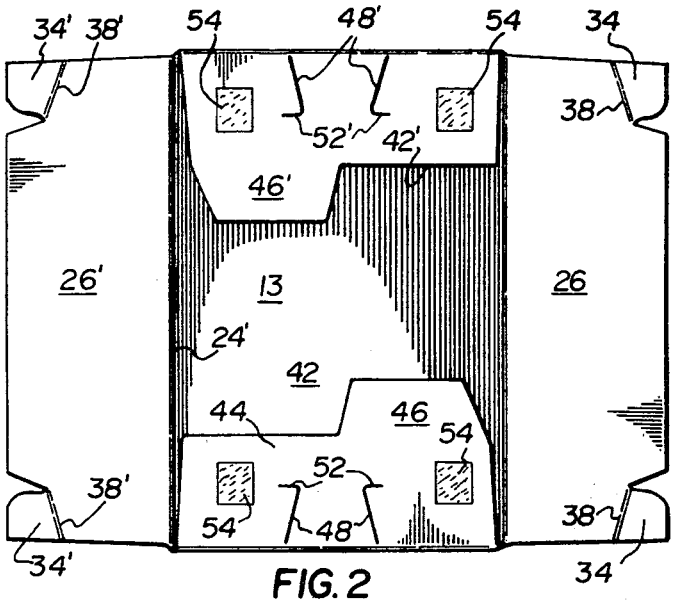
FIG. 2 is a plan view of the carton of FIG. 1 in an erected condition but wherein the end panels have been folded towards each other and overlie the container interior and the side panels have been folded away from each other, both side and end panels lying in a plane which would include the top wall of the container when formed.

Turning more specifically to FIGS. 2 to 4, these show the container of FIG. 1 in the erected condition, the collapsed version in FIG. 1 being erected by applying pressure to, in effect squeezing, the collapsed carton in the direction of the arrows shown in FIG. 1. The base of the container 13 is, as mentioned above, quite standard and is of the type which, upon applying pressure as aforementioned so as to form a rectangular wall structure or sleeve, automatically the bottom and end side panels lock into place and provide a firm bottom or base wall 13.

Turning in particular to FIG. 2, this is a plan view of the erected carton wherein the side panels 26 and 26' and end panels 42 and 42' are located in the plane which will include the top wall when formed, the side panels 26 and 26' having been folded away from each other whereas end panels 42 and 42' have been folded towards each other; the spacing between the extremities of the end panels 42 and 42' is clearly evident from this Figure.

The interior height of the carton is approximately the same height as the enclosed bottles or cans which means that the top wall when formed from the side and end panels contacts or almost contacts the crown corks or can tops of the enclosed bottles or cans respectively. It will be readily appreciated, therefore, that the slots 50 and 50' must be located in the end walls 42 and 42' respectively so as not to overlie a bottle or can top, otherwise it will be impossible to insert the tabs 34 and 34' through their associated slots. The areas enclosed by the dotted lines in FIG. 1 denote the location of a bottle top when the carton encloses six pint beer bottles and hence denotes the areas where a slot 50 or 50' may not be located.

Turning to FIG. 3, this illustrates the carton when sealed using automatic equipment. In effect, the side panels 26 and 26' as shown in FIG. 2 have been folded towards each other so as to overlie end panels 42 and 42'. Prior to their being folded, adhesive has been applied via automatic equipment to the outer surface of end panels 42 and 42' as indicated by the shaded areas 54 in FIG. 3.

FIG. 4 illustrates the carbon shown in FIGS. 1 and 2 closed or sealed in a mechanical manner as taught by the present invention. Each of tabs 34 and 34' have been displaced downwardly out of the plane of side panels 26 and 26' respectively the latter having been folded so as to overlie end panels 42 and 42' respectively with tabs 34 and 34' inserted through slots 50 and 50' respectively. Substantially all of each tab passes through its associated slot and is unable to slip out thereof since they are engaged and restrained by the board material defining the slot. In this embodiment, since substantially no board material is removed in forming the slots, the "door" portion deflected inwardly to allow the tab to enter into the carton is constantly urged, due to the resiliency of the board material, to return to its original undeflected condition which, because of the presence of the associated tab, it cannot achieve. The result is a very positive engagement between the end panel and the tab restraining the latter from slipping out. Since substantially all of each tab is located within the interior volume of the carton, mechanical securing using a tab member at each edge of side panels 26 and 26' results in the side panels lying in close proximity to, if not actually contacting, the end walls 42 and 42' respectively along virtually their full overlying length, the overall effect of which is that the mechanically closed carton is as pleasing to the eye as one sealed using adhesive and automatic machinery. Moreover, the sealed carton is almost as mechanically sound as the adhesive sealed carton.

It should be noted that for mechanical strength and integrity, it is not necessary to secure both side portions of each side panel 26 and 26' to the underlying end panel. The carton has sufficient strength and mechanical and structural stability to be used if only the end wall 42 (in this instance) adjacent to end wall 16 is secured to the overlying areas of side panels 26 and 26'. This ensures that the strain incurred as the full carton is picked up using the handhole is adequate and the overall integrity of the carton, upon which the strength, etc. relies, is not lost by e.g. excessive distortion such as bowing or tearing of the carton end wall 16.

As stated above, a major advantage of the carton of the present invention is that it can be filled and sealed using high speed automated equipment or rapidly and conveniently by hand.

To assemble, the "knocked down" or "flat" carton shown in FIG. 1 is squeezed, mechanically in the direction of the arrows. This erects the carton, forming the rectangular body and locking the base wall 13 in place. The carton is filled (top loaded), mechanically with six pint bottles of ale, lager or the like. The carton is then sealed using adhesive in the presently used manner. The operation may be summarized as follows six filled pint bottles are top loaded i.e. dropped into the carton as it travels on a conveyor; a double plough arrangement folds the two end panels 42 and 42' successively; adhesive is then applied to the end panels at locations 54; and the side panels 26 and 26' are then folded over and onto the end panels 42 and 42' respectively via a cam arrangement, the adhesive securing the two pairs of panels together. The machinery involved is quite standard and well-known in the art and it is felt need not be described in further detail.

To seal the cartons manually and without adhesive, as shown in FIG. 4, the erected carton as shown in FIG. 1 is produced by squeezing the flat carton manually in the direction of the arrows in FIG. 1 it is then filled manually with six pint bottles; the end panels are folded over to overlie the bottles; and the side panel 26 is then folded over, the thumbs of both hands conveniently and easily deflecting the tabs 34 downwards and inwards a little due to the angled fold lines 38, such that the leading edges of the tabs 34 readily enter the associated slots 50 and 50'. It will be noted that the use of slit 52 effectively creates in combination with slot 50, a "door" member which may, relatively easily, be deflected by tab 34 to gain entry but which then continuously attempts to regain its original position because of the inherent resiliency of the carton material and in so doing, engages the tab and prevents its being removed unless a significant extracting force is applied. Moreover, because the tab is always inclined at an angle to the hinge line 40, and consequently, the end wall upper edge, the natural tendency for the side panel 26 to "pop up" is utilized to increase the functional engaging force between the tab and the end panel, thus ensuring the mechanical integrity, strength, etc. of the carton. The latter tendency is further assisted to a significant extent in the preferred embodiment shown in FIGS. 1 to 4 by the combination of the curved edge 36 and angled hinge line 38, which results in the tab 34, following its insertion through a slot 50, bending to some extent under the end panel material adjacent the join of slot 50 and slit 52 and thereby contacting at least a portion of an edge of slit 52 to further enhance mechanical engagement of the side and end panels. Side panel 26' is treated in the same manner to complete closure of the carton. In fact, as can be seen from the drawings, sealing the carton mechanically in this manner is substantially equally as effective as sealing via adhesive as regards presentation and little, if any, loss of mechanical strength, results. Moreover, the carton can be opened and re-sealed, with no loss of efficiency, a number of times, an advantage especially in circumstances where the empty bottles are to be returned to collection centres, etc.

It should also be noted that the tapering effect brought about by the curved edge 36 also assists in inserting the tab in its associated slot since exact alignment of the tab with the whole length of the slot 50 is unnecessary; once entry of the tab having been commenced the remainder of the leading edge of the tab will automatically align itself with and enter the remaining opening of the slot. In this embodiment the hinge line 38 and slot 50 coincide upon the side panels overlying the associated end panels.

What I claim is:

1. A container comprising a base, end and side walls connected by hinge lines to one another; opposing pairs of end and side panels connected by hinge lines to the upper edges of respective end and side walls and extending substantially the length thereof, each end and side panel being adapted to fold toward its opposing respective end or side panel, said side panels being further adapted to overlie said end panels and co-act therewith to form the top wall with the longitudinal edges of said side panels substantially abutting; one of said end panels being provided with a pair of inwardly convergent slots closely straddling the centerline of said end panel, each said slot being oriented at an angle to the hinge line between said end panel and respective end wall; said end panel being further provided with a slit joined to the inner extremity of said slot and extending a very short distance toward the closest side wall and substantially parallel to said end wall hinge line; a pair of tabs, each tab disposed in the area of its respective side panel adapted to overlie said end panel containing said slots, said tabs being adapted to bend out of the plane of its respective side panel and enter said slots such that the tabs extend partially under a portion of the end panel between said slots thereby providing a strong frictional engagement at least a portion of an edge of said slits, whereby said side and end panels are mechanically secured together.

2. A container as claimed in claim 1 wherein a pair of tabs is disposed on each side panel, each tab disposed in the area of its respective side panel adapted to overlie said end panels, said tabs being adapted to bend out of the plane of its respective side panel and enter said slots such that the tabs extend partially under a portion of the end panel adjacent the join of said slots and slits thereby engaging at least a portion of an edge of said slits, whereby said side and end panels are adapted to be mechanically secured together.

3. A container as claimed in claim 2 wherein at least one said end wall, associated with an end panel provided with said slots, is provided with a handhole.

4. A container as claimed in claim 1, 2 or 3 wherein each slot is oriented at an angle of from about 45° to about 135° to the hinge line between the end panel containing said slot and its associated end wall.

5. A container as claimed in claim 1, 2 or 3 wherein a line defining the base of the tab is oriented at an angle of from about 45° and 135° to a line including the hinge line between the side panel and its associated side wall.

6. A container as claimed in claim 1, 2 or 3 wherein each tab is defined in part by adjacent portions of the lateral and longitudinal free edges of the associated side panel.

7. A container as claimed in claim 1, 2 or 3 wherein the tab is generally rectangular in shape, two sides of which are defined by adjacent portions of the lateral and longitudinal free edges of the associated end panel, the base of the tab having a width marginally less than the length of the slot, the free end of the tab being tapered to assist the tab's insertion in the slot.

8. A container as claimed in claim 7 wherein the tab includes a third free side which side is arcuate.

9. A container as claimed in claim 1, 2 or 3 wherein said slit extends away from said slot such that the angle defined by the slot and the slit is an acute angle.

* * * * *